United States Patent [19]

Lo et al.

[11] B 3,982,215

[45] Sept. 21, 1976

[54] METAL PLATED BODY COMPOSED OF GRAPHITE FIBRE EPOXY COMPOSITE

[75] Inventors: Gerald Joy-Pak Lo, Montreal; Francis Leo Papworth, Dollard des Ormeaux; Nicolas Elmars Tenne-Sens, Lachine; Michael Valentine O'Donovan, Dorval; Gerald Dziub, St. Laurent, all of Canada

[73] Assignee: RCA Corporation, New York, N.Y.

[22] Filed: Mar. 8, 1973

[21] Appl. No.: 339,194

[44] Published under the second Trial Voluntary Protest Program on February 3, 1976 as document No. B 339,194.

[52] U.S. Cl. ..... 333/73 W; 29/600; 333/95 R; 333/98 R

[51] Int. Cl.[2] ..... H01P 1/20; H01P 3/12; H01P 11/00

[58] Field of Search ..... 333/73 W, 95 R, 98 R; 117/204, 213, 215, 217, 219; 29/600

[56] References Cited

UNITED STATES PATENTS

| | | | |
|---|---|---|---|
| 3,607,350 | 9/1971 | Rathsack | 204/30 X |
| 3,716,869 | 2/1973 | Gould, Jr. et al. | 333/95 X |
| 3,808,028 | 4/1974 | Lando | 117/213 X |

OTHER PUBLICATIONS

Harvey–"Microwave Engineering" Academic Press, London and New York 1963; pp. 219–220 & 717.

"Microwave Transmission Design Data" Sperry Gyroscope Co. Brooklyn N.Y. pp. 88–89.

*Primary Examiner*—Archie R. Borchelt
*Assistant Examiner*—Marvin Nussbaum
*Attorney, Agent, or Firm*—Glenn H. Bruestle; Arthur E. Wilfond; William S. Hill

[57] ABSTRACT

An article, such as a microwave waveguide filter, composed of a body of graphite fibre epoxy composite having thereon an electrically conductive layer comprising a thin flash of nickel on the body and a thicker layer of copper on the nickel. The invention also includes a process in which the body is provided with a smooth surface, this smooth surface is then deglazed, or given a slight roughness, a thin flash of nickel is deposited electrolessly on the roughened surface and a heavier coating of copper is electrolessly or electrolytically deposited on the nickel.

1 Claim, 2 Drawing Figures

METAL PLATED BODY COMPOSED OF GRAPHITE FIBRE EPOXY COMPOSITE

BACKGROUND

Microwave waveguide filters, which usually comprise rectangular cross section tubular bodies, have generally been made of the alloy Invar 36. This is because these filters must not change their shapes, significantly, with temperature changes, since changes in shape affect the electrical characteristics of the device. Invar 36 has a very low coefficient of thermal expansion.

As long as weight of the filter is not a factor, Invar 36 is a satisfactory material to use for its construction. However, in applications such as communications satellites, where reduction in weight becomes of great importance, it is highly desirable to make such filters of a material which is not only lighter than Invar 36 but which in addition to the desirable electrical characteristics and the strength needed for such an application, has the low coefficient of thermal expansion of Invar 36.

One answer to this need is to make light weight microwave waveguide filters of graphite fibre epoxy composite material. This material is available in the form of narrow tapes which are composed of carbon fibres and uncured epoxy resins. The tape may be wound on a mandrel of suitable shape, until the tape is several layers thick so that the resultant article is a hollow tube which may have a rectangular cross section. The walls of the tube may be made of any desired thickness by varying the number of layers of tape.

After the layers of tape have been wound on the mandrel, the mandrel, so taped, is baked under ordinary atmospheric pressure at the curing temperature of the epoxy resin. The article so formed is then removed from the mandrel to make a light weight, strong, rigid article. In the past, however, these tubes have had certain disadvantages which greatly detracted from their efficiency as microwave waveguide filters. They are only slightly conductive, and although it has been known that the inner surface of a waveguide filter must have good electrical conductivity, past attempts to form a highly conductive surface on the graphite epoxy composite material have not been entirely successful. Another past disadvantage of the graphite fibre epoxy composite material has been its irregular surface. It is necessary that the inner surface of a microwave waveguide filter be as nearly plane as possible.

It was also found that the outside surface of the shaped graphite fibre epoxy article was subject to severe blistering due to voids which caused outgassing.

The present invention comprises an article made of graphite fibre epoxy composite material and having a good electrically conductive surface composed of a thin flash of nickel and a heavier coating of cooper. When used as a microwave waveguide filter which has a tubular shape, the inner surface of the tubular filter may first be made smooth and glossy and the glossy surface may then be made suitable for electroless plating by converting it to a slightly roughened finish. By using an alloy solder having a melting point of not more than about 150° C, areas of solder may be provided, where needed, on the copper coating.

THE DRAWING

FIG. 1 is a perspective view of a microwave waveguide filter made in accordance with the present invention, and FIG. 2 is a cross-section view taken along the line 2—2 of FIG. 1.

DESCRIPTION OF PREFERRED EMBODIMENT

Figure 1:
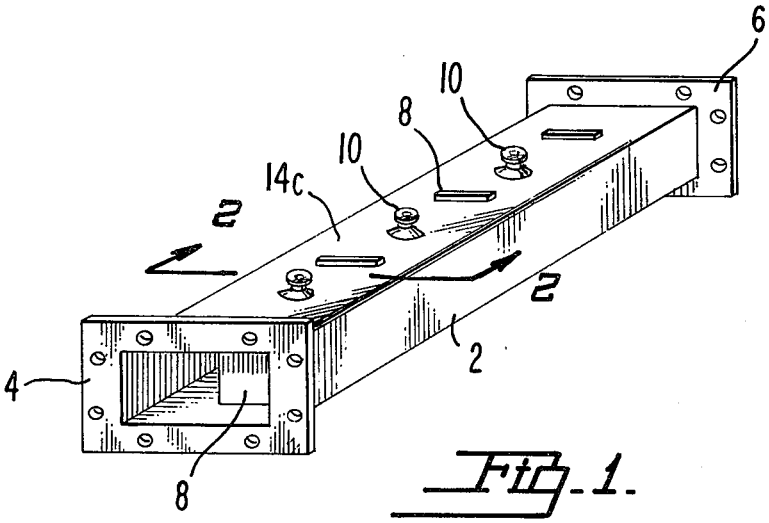

Although the method and article of the invention have application to various devices, the invention will be particularly described in connection with making a microwave waveguide filter. As shown in the drawing, a waveguide filter may comprise a tubular body 2 having a rectangular cross section, with metal flanges 4 and 6 attached to opposite ends. The tubular body 2 is composed of cured graphite fibre epoxy material.

The body is shaped and given a glossy inside finish by winding six layers of uncured graphite epoxy tapes on an aluminum mandrel and then baking to cure the epoxy resin under a pressure of at least 70 p.s.i. (about 4.9 Kg/sq. cm.). The so cured graphite fibre epoxy tube is then removed from the mandrel. Baking under pressure has resulted in eliminating the former blister problem.

Within the tubular body 2 is a series of obstacles 8, spaced approximately equidistant from each other. These obstacles are mounted in suitably shaped slots which are in two opposite walls of the interior cavity of the filter. They are preferably made of the same graphite fibre epoxy material as the walls of the tubular body 2. The dimensions and spacing of the obstacles help to determine the bandpass characteristics of the filter.

In one of the same walls of the tubular body 2 as the obstacles 8 are mounted on, is a series of metal bushings 10 fitted in openings through the body wall. These bushings are threaded to receive threaded slugs (not shown) which are adjustable to aid in compensating for inaccuracies of spacing of the obstacles 8 and to help to tune the filter.

The inner and outer walls of the tubular body 2 are coated with composite metallic coatings 12 and 14 respectively. Coatings 12 and 14 each consists of a thin nickel flash **12*a* and 14*a* adhered to the graphite fibre epoxy composite material that constitutes the walls of the tubular body 2 and a heavier coating of copper 12*b* and 14*b* deposited on the nickel. The copper coating may also be covered with a coating of silver 12*c* and 14*c***.

Around each of the bushings 10 is a layer of solder 16 which adheres to the copper coating **14*b* but is beneath the silver coating 14*c*** when a silver coating is present.

An example of how the composite metal coatings 12 and 14 are deposited will now be given. At this stage, the obstacles 8 and bushings 10 are not yet mounted in place.

Since the interior walls of the tubular body 2 have a glossy surface upon which it would be very difficult to deposit a continuous, adherent coating of metal electrolessly, the glossy surface is abraded lightly with a stream of the smallest diameter grade of glass beads. This converts the surface to a slightly roughened condition. The abrading action is carried out just long enough to remove the gloss. Too much roughening affects the electrical characteristics of the completed device.

After the abrading is completed, the roughened surface is rinsed with water, vapor degreased, rinsed again and the entire body is dipped in a hydrochloric acid bath (1:1) for 5 minutes to remove contaminants, and rinsed again. The surface is now ready for the sensitization treatment.

In order to sensitize the inner and outer surfaces of the tubular body 2 for deposition of nickel, they are treated with a sensitizing solution which is preferably a combination of $SnCl_2$ and aged $SnCl_4$ with added NaCl. A stock solution of $SnCl_2$ is prepared by dissolving 2.5 moles of $SnCl_2$ in 1 liter of an aqueous hydrochloric acid solution. A stock solution of 0.5 molar $SnCl_4$ is also made up and this solution is aged for one week. The working solution consists of 50 ml of the $SnCl_2$ solution, 15 ml of the aged $SnCl_4$ solution, 3 moles of NaCl and water to make one liter.

The body 2 is dipped in the above described sensitizing solution for three minutes and is then removed and rinsed with water.

The sensitized body is then activated with a solution of $PdCl_2$. This solution is taken from a concentrated stock solution made up by dissolving 10g $PdCl_2$ and 10 ml conc. HCl in enough water to make up 1 liter of solution. The working solution consists of 50 ml of the concentrate per liter of aqueous bath.

The body is removed from the activator bath, rinsed with water and then it is immersed in nickel plating solution which is maintained at 70° to 75° C. The composition of the nickel bath is as follows:

| | |
|---|---|
| Nickel ion (as sulfamate, sulfite chloride, etc.) | 5.5 g |
| Sodium hypophosphite | 25 g |
| Sodium formate | 0.5 moles |
| Water to make 1 liter. | |

This bath may be adjusted to a pH of 4 to 4.3 with potassium carbonate or sulfamic acid as needed.

Figure 2:
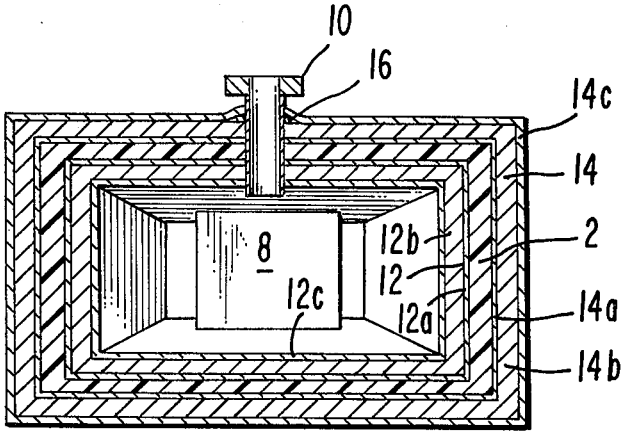

The body remains in the slightly agitated plating bath for 10 minutes, which deposits nickel electrolessly, until a thin flash of nickel 12*a* is deposited on the inner walls of the body 2 and a similar coating 14*a* is deposited on the outer walls (FIG. 2).

After the nickel flash has been deposited on both the inner and outer walls of the body 2, the body is removed from the nickel bath, rinsed and dried. The plated body is then heated in an oven (in an air ambient) at 175° C for 1 hour, and then cooled gradually. This treatment has been found to harden the nickel and improve its adhesion to the walls of the body 2.

After cooling, the body 2, with the coatings of nickel, is vapor degreased and immersed in an alkaline cleaner which is mainly sodium hydroxide.

After rinsing, the cleaned body is activated by holding it in a solution of sulfuric acid containing 25% by volume concentrated $H_2SO_4$. The body 2 is made a cathode and a stainless steel container serves as an anode. A current sufficient to cause slight gassing is passed through the solution.

The activated body is then electrolytically flashed with nickel (not shown) in a solution composed of 240 g/l of $NiCl_2$ and 120 ml/l of concentrated HCl. The flashed body is then rinsed and flashed with copper (not shown) in a solution containing 250 g/l of $CuSO_4.5H_2O$ and 50 g/l of concentrated $H_2SO_4$. The flash coating of copper is electrolytically deposited at 30 amps/sq. ft. (about 324 amps/sq. meter) for 10 seconds and then heavier coatings of copper 12*b* and 14*b* which are about 0.001 to 0.002 of an inch (about 25 to 100 microns) thick are deposited on the inner and outer walls, respectively, from the same bath at 10 amps/sq. ft. (about 108 amps/sq. meter). The rate of deposition is about 0.5 mil/hr (about 12 microns/hr).

After the plated body is removed from the copper bath, rinsed and dried, the obstacles 8 (which were separately plated with nickel and copper) and bushings 10 are soldered into place. This leaves solder layers 16 deposited around the bushings 10. The solder used is a low-melting alloy composed of 80% indium, 15% lead and 5% silver. The melting point of the solder should not be higher than about 150° C.

Next, the entire assembly may be given a coating of silver 12*c* and 14*c* to further increase the electrical conductivity of the inner walls. Before the silver is applied, the body is once more vapor degreased, alkaline bath cleaned, rinsed, dried and given a copper strike. Before being given the copper strike, the body is treated in a bath composed of hydrogen peroxide (1 vol.), acetic acid (2 vols.), water (5 vols.), rinsed and then dipped in a bath of potassium cyanide (60 g/l). After being given the copper strike, the body is rinsed and given a silver strike by immersion in a bath composed of 5 g/l of AgCN, 150 g/l of KCN, and 15 g/l of $K_2CO_3$, with a current sufficient to cause slight gassing through the bath for about 0.5 minute.

Next, a silver coating is applied electrolytically in a bath composed of 45 g/l of silver cyanide, 90 g/l of potassium cyanide and 90 g/l of potassium carbonate.

After being plated with silver, the body may be given an additional plating of gold (not shown).

We claim:

1. A hollow microwave waveguide filter having good inner surface electrical conductivity comprising a tubular shaped body composed of graphite fibre epoxy composite, said body having its inner surface slightly roughened, a thin flash coating of hardened nickel on said inner surface, a thicker coating of copper on said nickel coating, a coating of silver over said copper coating, a thin flash outer coating of hardened nickel on the outer surface of said body, a thicker outer coating of copper on said outer nickel coating solder areas on said outer copper coating, said solder having a melting point of up to about 150°C., and a coating of silver over said solder areas and outer copper coating.

* * * * *